US005456549A

United States Patent [19]

Paladeni

[11] Patent Number: 5,456,549

[45] Date of Patent: Oct. 10, 1995

[54] POWERED ROTARY SCREED

[76] Inventor: Tod Paladeni, 1316 NW. Westridge St., Vancouver, Wash. 98665

[21] Appl. No.: 262,591

[22] Filed: Jun. 20, 1994

[51] Int. Cl.[6] ..... E01C 19/22

[52] U.S. Cl. ..... 404/103; 404/118; 404/132

[58] Field of Search ..... 404/101, 103, 404/118, 119, 132

[56] References Cited

U.S. PATENT DOCUMENTS

| | | | |
|---|---|---|---|
| 4,340,351 | 7/1982 | Owens | 404/118 X |
| 4,577,994 | 3/1986 | Miller . | |
| 4,931,008 | 6/1990 | Morrison . | |
| 4,964,754 | 10/1990 | Garner et al. . | |
| 5,046,889 | 9/1991 | Sterner, Jr. | 404/103 |

OTHER PUBLICATIONS

"Razorback Screeds," 9-pg. brochure, Allen Engineering Corp., Paragould, Ark., 1992.

"Bunyan," 1-pg. brochure, Bunyan Industries, Salt Lake City, Utah, undated.

"There Are No Finer Finishers Available," M-B-W, Inc., Slinger, Wis., 1-pg. ad in *Concrete Construction*, 34:538, Jun. 1989.

*Primary Examiner*—Ramon S. Britts
*Assistant Examiner*—James A. Lisehora
*Attorney, Agent, or Firm*—Klarquist Sparkman Campbell Leigh & Whinston

[57] ABSTRACT

A powered rotary screed has a plurality of interchangeable modules of different lengths so that the power screed can accommodate a range of job applications. Additionally, the rotary screed comprises a centrally located expansion member that can be adjusted to cause an upper ridge member of the rotary screed to expand outward, thus raising a medial portion of the roller screeds so that they may be adjusted to maintain horizontal alignment. The screed is propelled by two drive tubes that are supported by drive modules and powered by hydraulic motors. The screed further comprises a two-section strike tube which is likewise powered by a hydraulic motor. An operator rides in an operator's station and controls the speed and direction of the rotary screed.

17 Claims, 4 Drawing Sheets

POWERED ROTARY SCREED

BACKGROUND OF THE INVENTION

1. Field of the Invention

This invention pertains to the field of screeds for screeding cementious material and more particularly to power-driven screeds.

2. Description of the Related Art

A non-powered roller screed is sold by Bunyan Industries of Salt Lake City, Utah. The roller screed consists of an elongate tube having rotatably mounted handles at its distal ends. The roller screed is used on freshly poured cement by placing it on top of a pair of spaced apart and parallel rails that are set level with the desired surface height for the concrete pad being formed. The roller screed is then pulled along the top of the rails pushing excess cement ahead of it and leaving a flat level surface behind it which may be finished with trowels after the cement has set enough to support the weight of people and tools. Several deficiencies can be readily noted with the rotary screed just described: mainly, being manually operated, it requires two strong operators to pull the screed and move excess cement, and the length of the screed is limited. Screeds over twenty feet long sag in the center and create an uneven cement surface. Thus, it is desirable to create a roller screed that is easier to operate and that can be longer than twenty feet without sagging.

A powered screed is shown in Morrison, U.S. Pat. No. 4,931,008, which discloses a vibrating screed that structurally consists of a ridge beam supported by a plurality of knee braces connected to a T-shaped screed blade and a bull float blade. The individual sections are connected by a modified turnbuckle that can be adjusted to make the screed and bull float blades level. This general concept has been incorporated into screeds sold by M-B-W, Inc., of Slinger, Wis., which claims that its screeds can maintain commercial finishing tolerances at screed lengths up to 60 feet. However, the angle iron screed blades associated with these screeds are less desirable than roller screeds.

A powered roller screed is shown in Garner et al., U.S. Pat. No. 4,964,754, which discloses an operator driven power roller screed having tandem drive rollers and a screed roller. Although Garner et al. overcomes the problems associated with the manual roller screed, the apparatus is large and cumbersome to move into place and must be relatively short, as compared to the Morrison-style screed, to avoid sagging in the middle.

SUMMARY OF THE INVENTION

The present invention solves the above-noted deficiencies by providing a modular, powered, rotary screed system having a centrally located adjustment member for vertically adjusting the screed so that it can be kept flat, even with long lengths. Preferably, the powered rotary screed of the present invention comprises two drive modules and two screed modules. The modules are arranged so the screed modules are connected together and the drive modules are at the outermost, distal ends of the rotary screed system.

Each drive module has a frame structure with vertically arranged plates at its ends. A drive tube is rotatably connected to the plates and powered by an hydraulic motor. One drive module will support a power supply and hydraulic pump, while the other drive module will support an operator station having controls and a seat for an operator. The hydraulically driven drive tubes are the motive force for propelling the rotary screed.

Preferably, the screed modules are available in four-foot lengths so the overall screed length can be configured for specific job sizes. Each screed module has a frame that is connected at one end to one of the plates associated with the drive module and is connected at its other end to a medial plate. A strike tube is associated with each such screed module and is supported by the medial plate at one end and supported at its other end by an outermost, or distal, plate associated with each drive module.

In the preferred embodiment, the module frames spanning the vertically arranged plates comprise three horizontally oriented stringers: one ridge stringer and two base stringers. Further structural rigidity is provided by connecting sheet metal between the stringers. The stringers connect to the plates by bolted connections except at the point where the ridge stringers connect to the medial plate, which connects by means of an adjustment member.

Preferably, the adjustment member is a pair of power screws that are threaded into the ridge stringers and are rotatably connected to the medial plate. The power screws adjust the horizontal alignment of the strike tubes so that the strike tubes will not sag when the screed is configured into long lengths. The adjustment works by rotating the power screws so they thread out of the ridge stringers and press against the medial plate, thereby increasing the effective length of the ridge stringers. The system accommodates the increased ridge stringer length by "bowing" so that the medial portion of the rotary screed raises vertically.

The foregoing and additional features and advantages of the present invention will be more readily apparent from the following detailed description, which proceeds with reference to the accompanying drawings.

DETAILED DESCRIPTION OF THE PREFERRED EMBODIMENT

Figure 1:
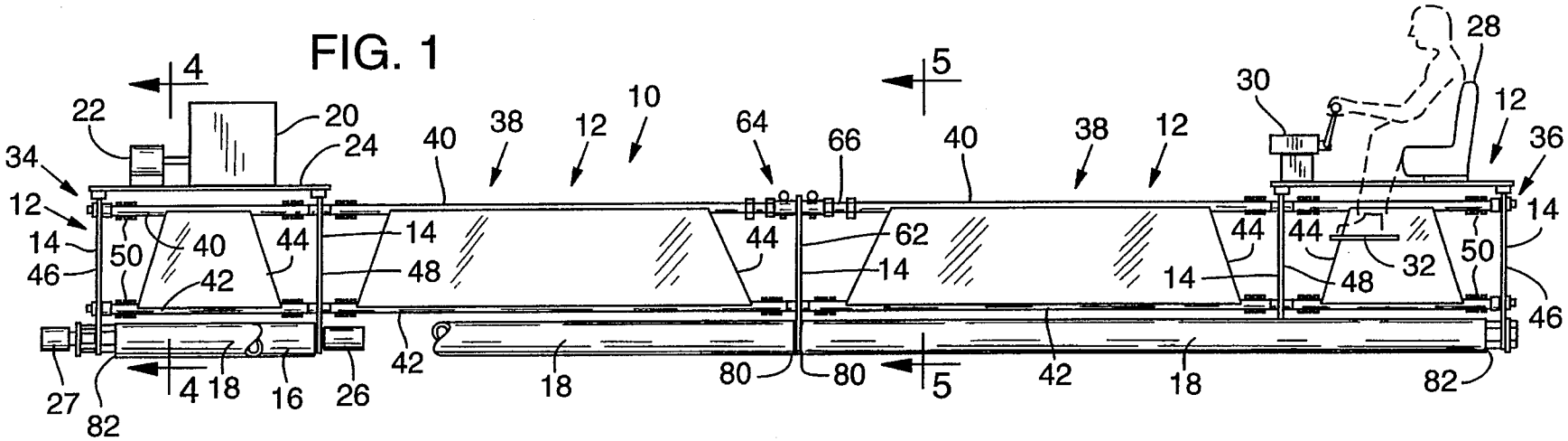
FIG. 1 is a front, elevation view of a preferred embodiment of a powered rotary screed of the present invention.

In FIG. 1 there is shown a front elevation view of a powered rotary screed 10 of the present invention. In this preferred embodiment, the rotary screed is comprised of four modules 12 separated by structural plates 14. A pair of drive tubes 16 (only one drive tube shown) and a strike tube 18 are rotatably connected to the plates 14. At one end of the rotary screed a power supply 20 and hydraulic pump 22 are mounted onto a platform 24. The hydraulic pump supplies hydraulic pressure to hydraulic motors 26 which power the drive tubes 16 and motors 27 which rotate the strike tubes 18. At the other end of the rotary screed there is located an operator station having a seat 28, control station 30 and foot rest 32.

As stated, the rotary screed 10 is preferably comprised of four modules 12. In the preferred embodiment, the modules comprise drive modules 34 and 36 and two screed modules 38. All the modules 12 share the common characteristic of a frame section having a ridge stringer 40 whose ends are connected to the top portions of the structural plates 14 and two base stringers 42 connected to the bottom portions of the plates 14. The ridge stringers and base stringers are connected by metal sheets 44 for rigidity.

The drive modules 34 and 36 are preferably a standard length of approximately four feet. The drive modules 34, 36 have a frame including the stringers 40 and 42. At their outermost, distal ends, the stringers 40, 42 are connected to a distal plate 46 by a fastening system 50. At their other end, the stringers 40, 42 are connected to an intermediate plate 48.

Figure 2:
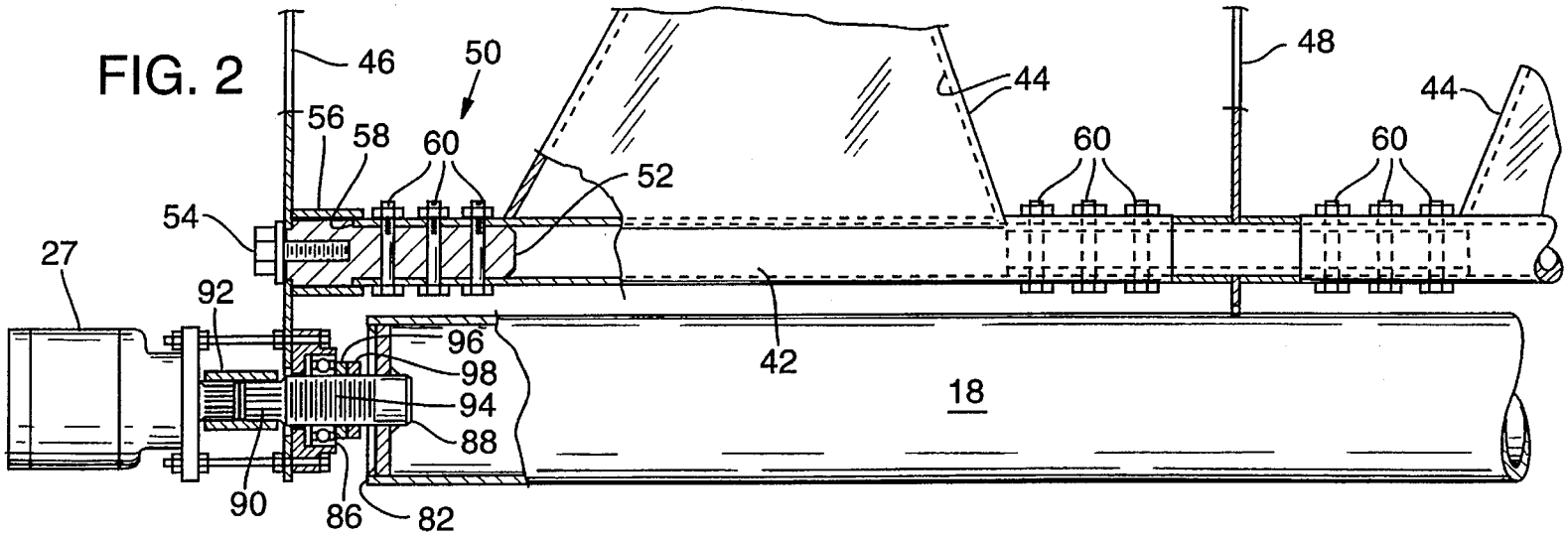
FIG. 2 is an enlarged front, elevation view of the powered rotary screed of FIG. 1 that has been partially cut away to show details of the connections of various frame components and the connection of a roller screed to a plate and hydraulic motor.

As can be seen in greater detail in FIG. 2, the fastening system 50 comprises a tenon 52 that is bolted to the distal plate 46 by a bolt 54. The tenon is received within a socket 56 that is welded to the distal plate 46. The base stringer 42 fits over an end of the tenon 52 and slides toward the distal plate 46 until it abuts shoulders 58 on the tenon 52. Holes are provided through the base stringer 42 and tenon 52 to receive bolts 60 for securing the stringer and, in turn, the distal plate 46. In a like manner, all of the stringers are connected to the structural plates 14 with the exception of the medial connections of the ridge stringer 40, which connection will be described separately below.

Both drive modules 34, 36 include one drive tube 16 that spans between the distal plate 46 and the intermediate plate 48. Attached to each drive tube is a hydraulic motor 26 that rotates the drive tube, which in turn propels the rotary screed 10. The drive tubes attach to plates 46, 48 by means of rotary thrust bearings as described below in connection with the strike tube 18. The drive tubes will preferably have a high friction surface such as rubber or similar material.

The screed modules 38 are preferably available in a plurality of lengths at four-foot increments. For example, screed modules may be available at lengths of 4, 8, 12, 16 feet, etc. The four-foot increments of the screed modules coincide with the preferred embodiment of the four-foot length for the drive modules so that the rotary screed can always be configured for the proper width of a screed job. As noted above, screeds ride on guide rails (not shown). By coordinating the length increments of the screed modules to the preferred length of the drive modules, the rotary screed 10 can always be configured so that the drive rollers will ride on guide rails regardless of their separation distance.

Each screed module 38 connects at one end to one intermediate plate 48 and connects at its other end to a medial plate 62. As stated above, the screed modules 38 have the ridge stringer 40 and two base stringers 42 that are interconnected by the structural skin 44.

The ridge stringers of the screed modules 38 connect at the medial plate 62 by means of an expansion member 64. As seen most clearly in FIG. 3, the expansion member 64 comprises two power screws 66 that thread into collars 68 that are welded to the ridge stringers 40. Each power screw 66 is provided with a threaded portion 70, a shoulder nut 72 and a smooth surface stub 74. The stub 74 is received within a receptacle 76 that is welded to the medial plate 62. A hole is provided through receptacle 76 and stub 74 to receive a pin 78 for securing the power screw 66. Because the stub is smooth-surfaced, it is easily removed from, and inserted into, the receptacles 76, without turning the power screws 66 or unscrewing them from the ridge stringer 40.

The purpose of the expansion member 64 is to adjust the effective length of the ridge stringers 40. When one or both of the screws 66 are rotated to increase the effective length of the ridge stringers 40, top portions of the plates 46, 48 on one side of the medial plate are moved away from top portions of the corresponding plates 46, 48 on the other side of the medial plate, thereby causing the medial plate 62 to move upward raising medial ends 80 of the strike tubes. In this manner, the rotary screed 10 can be configured for long lengths because any sag that occurs in which the medial ends 80 of the strike tubes dip below distal ends 82 can be adjusted by turning the power screws 66.

A platform 24 is mounted onto the top of the drive module 34 for supporting a power supply 20 and pump 22. Preferably, the power supply 20 is a gasoline-powered engine that is coupled to a hydraulic pump 22 for generating hydraulic pressures for running hydraulic motors 26 and 27. Alternatively, the power supply 20 could be a gasoline-powered generator generating electricity to drive an electric hydraulic pump that would supply hydraulic pressure to run the hydraulic motors. Alternatively, the power supply could be an electric generator supplying electricity to electric motors, instead of the hydraulic system with hydraulic motors 26, 27.

On top of the drive module 36 is an operator station having seat 28 and control panel 30. Preferably, the operator will have controls for controlling the speed and direction of each drive tube 16 individually as well as for controlling the direction and rotary speed of the strike tubes 18.

As noted, the rotary screed 10 preferably comprises two drive tubes 16 and two strike tubes 18. Each drive tube 16 extends between one distal plate 46 and one intermediate plate 48. Each strike tube 18 extends from one distal plate 46 to the medial plate 62, passing beneath the intermediate plates 48. Hydraulic motors 26 drive the drive tubes 18. Hydraulic motor 27 drives the strike tube 18. Preferably, the strike tube will be driven in a rotational direction opposite to that of the drive tubes for optimal screeding of the cementious material. In the preferred embodiment, the drive tubes will be capable of propelling the screed 10 at speeds up to 45 ft/min., and the strike tubes can be rotated at speeds up to 200 rpm.

Figure 3:
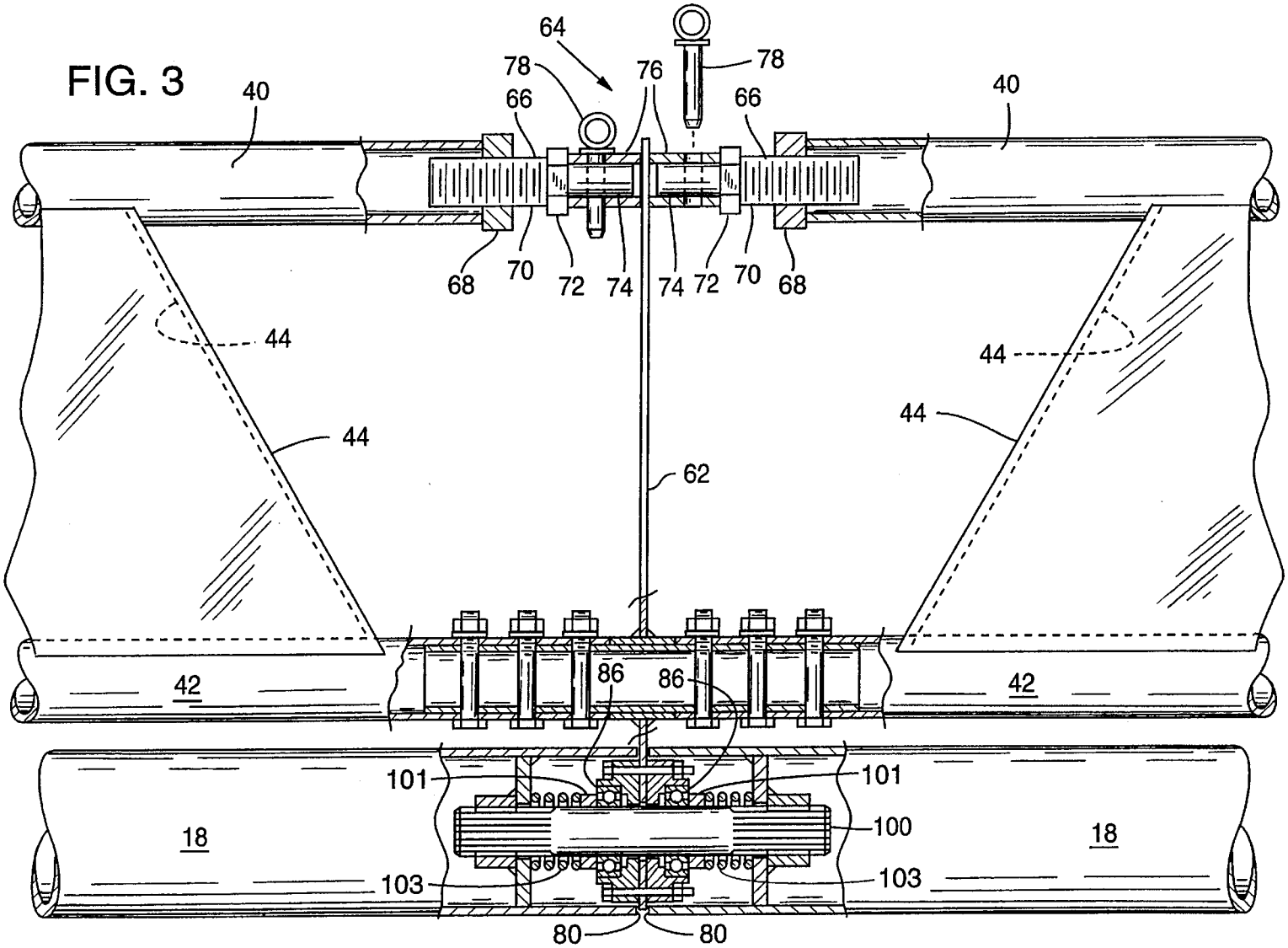
FIG. 3 is an enlarged front elevation view of the powered rotary screed of FIG. 1 that has been partially cut away to show the detail of the frame connection to a medial plate.

As best shown in FIG. 2, the tubes 18 are connected to the plates 14 by thrust bearings 86 that are bolted to the plates. Where the tubes connect to a hydraulic motor 27, a splined and threaded shaft 88 is provided wherein the splined portion 90 passes through the plate and connects to a coupler 92, which in turn connects to the hydraulic motor 27. On a threaded portion 94 of the shaft 88 are two nuts: jam nut 96 and lock nut 98. With reference to FIG. 2, it can be seen that turning jam nut 96 so that it progresses along the threaded portion 94 in the direction of the hydraulic motor 27 will urge the strike tube 18 away from the distal plate 46 and toward the medial plate 62. The adjustment of the strike tube 18 in the direction of the medial plate 62 is resisted by a compression spring 103 (FIG. 3). After the jam nut 96 has been properly snugged against the thrust bearing 86 so that the strike tube 18 is properly mounted between the distal plate 46 and the medial plate 62, then the lock nut 98 can be tightened against the jam nut 96 to lock it into position. Drive tubes 16 are likewise rotatably connected to plates 48 and hydraulic motors 26.

The tubes 18 connect to the medial plate 62 in a similar fashion. In FIG. 3 it is seen that the strike tubes 18 are fixedly connected to a splined shaft 100 that is connected to the thrust bearings 86 by set screws in collars 101. Springs 103 encircle the shaft 100 and are compressed between the strike tubes 18 and the medial plate 62 for urging the strike tubes toward the distal plates 46 so the strike tubes will not rub against the medial plate.

Figure 4:
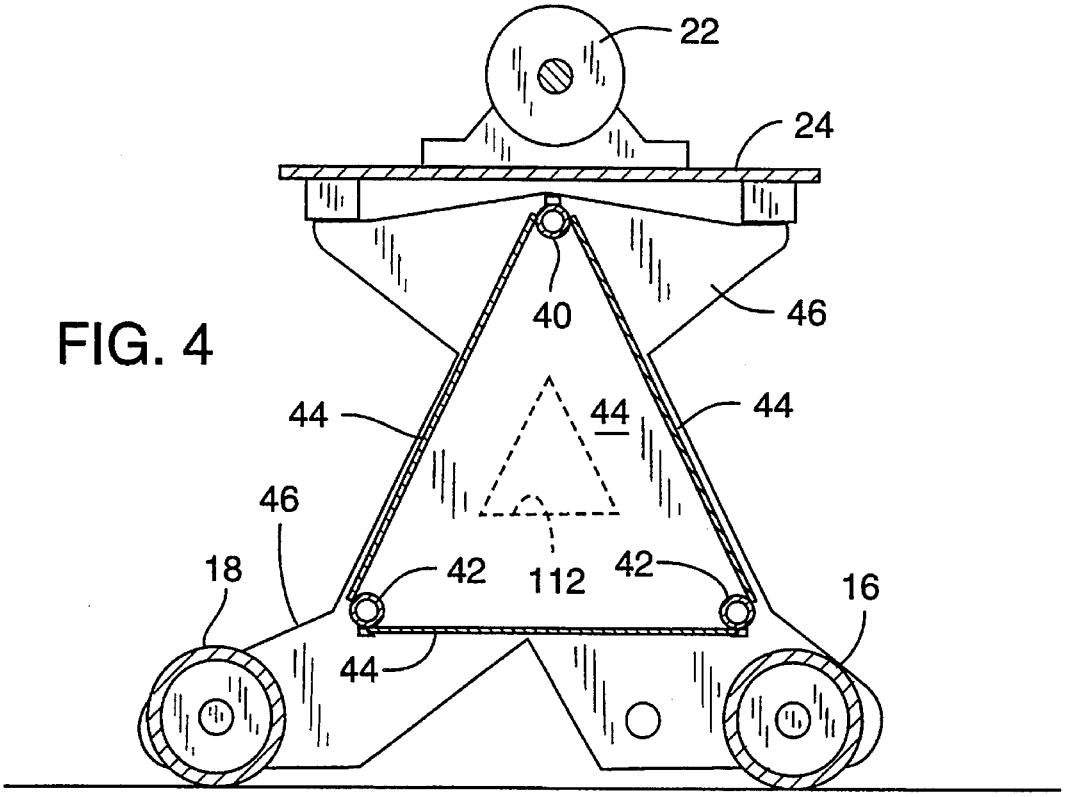
FIG. 4 is a cross-section view taken along line 4—4 in FIG. 1.
Figure 5:
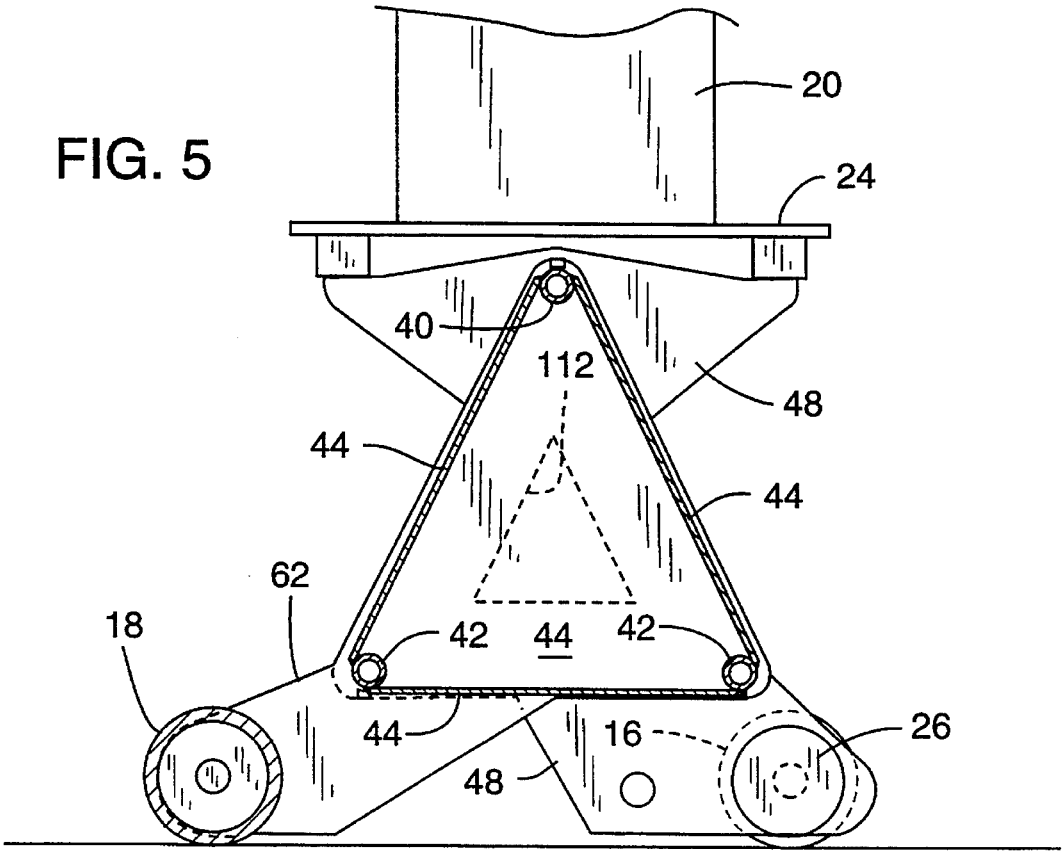
FIG. 5 is a cross-section view taken along line 5—5 of FIG. 1.

FIGS. 4 and 5 show cross-sections taken along lines 4—4 and 5—5 of FIG. 1, respectively. In FIG. 4 there can be seen the hydraulic pump 22 resting atop platform 24 mounted onto a top surface of the distal plate 46. Ridge stringer 40 and base stringers 42 are connected by the structural skin 44. Drive tube 16 and strike tube 18 are shown connected to lower portions of the distal plates 46. In FIG. 5 there is shown a further cross-section through the rotary screed 10 looking towards the medial plate 62.

Figure 6:
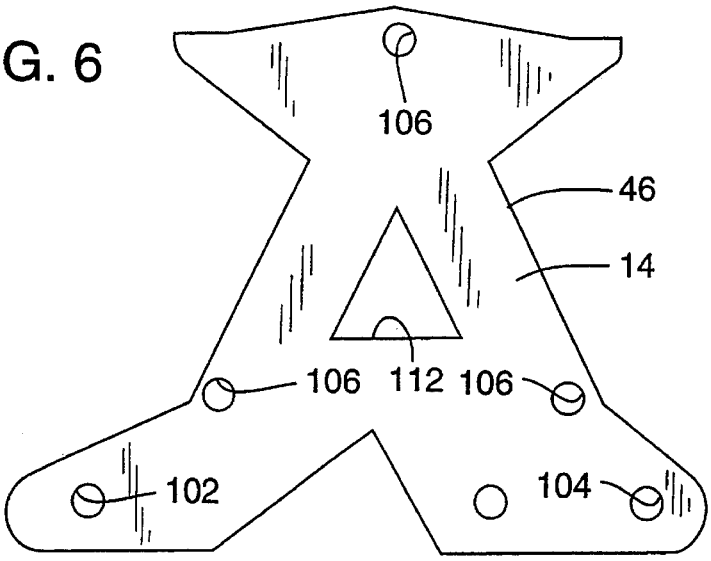
FIG. 6 is a side elevation view of a preferred embodiment of a distal plate of the present invention.
Figure 7:
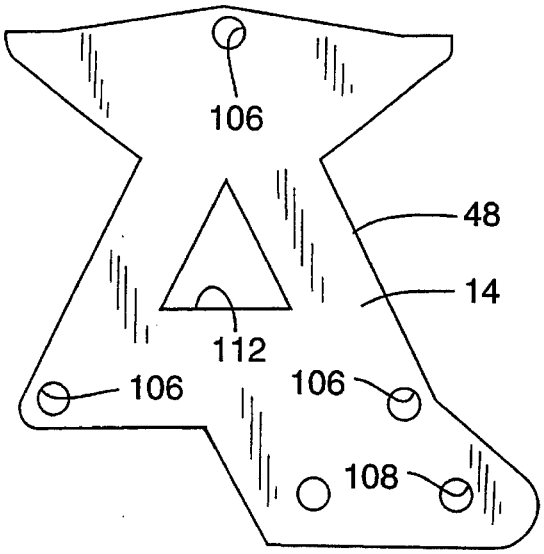
FIG. 7 is a side elevation view of a preferred embodiment of an intermediate plate of the present invention.
Figure 8:
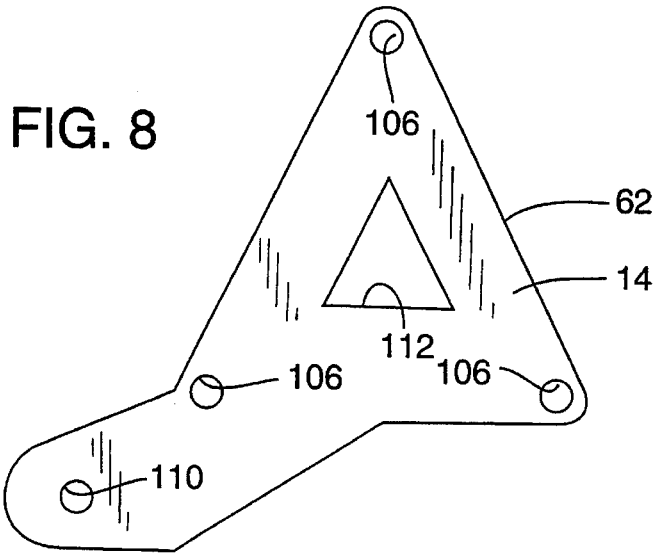
FIG. 8 is a side elevation view of a preferred embodiment of a medial plate of the present invention.

FIGS. 6–8 show the configurations of the distal plate 46, intermediate plate 48 and medial plate 62, respectively. The distal plate 46 contains holes, 102, 104 near its lower region for receiving the mounting splines of the strike tube and drive tube, respectively. Holes 106 are provided for connection to the stringers 40 and 42. The intermediate plate 48 has a hole 108 to receive the connecting spline for the drive tube, but is cut out to permit the strike tube 18 to pass beneath the intermediate plate 48.

Medial plate 62 has a hole 110 for connecting to the strike tubes 18. All of the plates 46, 48, and 62 are provided with a cutout 112 in order to reduce weight.

In view of these and the wide variety of other embodiments to which the principals of the invention can be applied, the illustrated embodiments should be considered exemplary only and not as limiting the scope of the invention.

I claim as the invention all such modifications as may come within the scope and spirit of the following claims and equivalents thereto.

I claim:

1. A rotary screed, comprising:

(a) a frame;

(b) a plurality of structural plates, including a medial plate and two distal plates, each plate having an upper margin;

(c) an elongate strike tube having two ends and a medial region between the ends, the tube being rotatably supported at its ends by respective distal plates and rotatably connected to the medial plate at the medial region; and (d) an expansion member connected to the frame and operable to move the upper margins of the distal plates toward or away from one another thereby moving vertically the strike tube at the medial location.

2. The screed of claim 1 wherein the strike tube comprises two tube sections, each tube section having a first end rotatably supported by one distal plate and having a second end rotatably supported by the medial plate.

3. The screed of claim 1 wherein the expansion member comprises a power screw threadingly engaged with the frame and rotatably engaged with the medial plate wherein rotation of the power screw moves apart the upper margins of the distal plates.

4. The screed of claim 1 wherein the frame comprises a plurality of stringers, including a ridge stringer, and the expansion member is operably engaged with the ridge stringer and the medial plate.

5. A powered rotary screed, comprising:

(a) a frame having a plurality of stringers including a ridge stringer;

(b) a plurality of plates including two distal plates and a medial plate wherein each plate has a top margin, and the plates are connected proximate their top margins by the ridge stringer;

(c) at least one drive tube rotatably connected to at least two of the plurality of plates;

(d) a strike tube rotatably connected to at least two of the plurality of plates; and (e) at least one power screw that is engaged with the ridge stringer and the medial plate wherein rotation of the at least one power screw acts on the ridge stringer causing the top margins of the distal plates to move apart, thereby causing the strike tube to move vertically proximate the medial plate.

6. The powered rotary screed of claim 5 wherein the plurality of plates further includes two intermediate plates, each intermediate plate located between a respective distal plate and the medial plate.

7. The powered rotary screed of claim 6 wherein the at least one drive tube comprises two drive tubes and each drive tube is located between, and rotatably connected to, a distal plate and an intermediate plate.

8. The powered rotary screed of claim 5 wherein the strike tube comprises two elongate sections that are fixedly connected together, rotatably connected to the medial plate, and rotatably connected to the distal plates.

9. The powered rotary screed of claim 5 further comprising a hydraulic motor for driving the at least one drive tube.

10. The powered rotary screed of claim 9 further comprising a second hydraulic motor for rotating the strike tube in a rotational direction opposite the rotational direction of the drive tube.

11. The powered rotary screed of claim 5 further comprising an operator station fixedly mounted on the top margin of a distal plate and having controls for controlling the operation of the screed.

12. A powered rotary screed, comprising:

(a) two drive modules, each drive module having a frame, a distal plate and an intermediate plate connected to opposite ends of the frame, and a drive tube rotatably supported by the distal plate and the intermediate plate;

(b) a medial plate;

(c) two screed modules, each screed module having a frame connected to the intermediate plate at one end and connected to the medial plate at a medial end thereof, and a strike tube rotatably connected to the distal plate and the medial plate; and (d) an expansion member connected to the screed module frames and the medial plate wherein expansion of the expansion member moves apart an upper margin of the distal plates, thereby moving vertically the medial ends of the screed modules.

13. The powered rotary screed of claim 12 wherein the drive modules further comprise a motor for imparting rotational motion to the drive tubes.

14. The powered rotary screed of claim 12 wherein the screed modules further comprise a motor for imparting rotational motion to the strike tubes.

15. The powered rotary screed of claim 12 wherein the drive module frames and the screed module frames each comprise a plurality of interconnected stringers.

16. The powered rotary screed of claim 12 wherein the expansion member comprises a power screw operably connected to one screed module frame and the medial plate.

17. The powered rotary screed of claim 16 wherein the screw is threadingly engaged with one screed module frame and rotatably engaged with the medial plate.

* * * * *